US005949679A

United States Patent [19]

Born et al.

[11] Patent Number: 5,949,679

[45] **Date of Patent: *Sep. 7, 1999**

[54] GOLF SCORING COMPUTER SYSTEM

[75] Inventors: Richard Arthur Born, Orono; Carol Jean Cajacob, Minneapolis; Jeffrey Ervin Stenerson, Waconia, all of Minn.

[73] Assignee: Tournament Tracker, Inc., Wayzata, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/675,147

[22] Filed: Jul. 3, 1996

[51] Int. Cl.[6] ..... G06F 15/44; G06F 15/28; A63B 67/02

[52] U.S. Cl. ..... 364/410.1; 364/411.1; 463/42; 473/409; 473/131

[58] Field of Search ..... 473/131, 409, 473/1; 463/1, 30–31, 36, 39–42; 364/410, 411; 340/323 R

[56] References Cited

U.S. PATENT DOCUMENTS

| | | |
|---|---|---|
| 4,142,236 | 2/1979 | Martz et al. . |
| 4,367,526 | 1/1983 | McGeary et al. . |
| 4,764,666 | 8/1988 | Bergeron . |
| 4,910,677 | 3/1990 | Remedio et al. . |
| 5,095,430 | 3/1992 | Bonito et al. . |
| 5,097,416 | 3/1992 | Matthews . |
| 5,127,044 | 6/1992 | Bonito et al. . |
| 5,283,733 | 2/1994 | Colley . |
| 5,305,201 | 4/1994 | Matthews . |
| 5,319,548 | 6/1994 | Germain . |
| 5,324,028 | 6/1994 | Luna . |
| 5,326,095 | 7/1994 | Dudley . |
| 5,507,485 | 4/1996 | Fisher . |

OTHER PUBLICATIONS

"System Specifications: Electronic Golf Computer", http://www.vast.co.za/System_Specification.html, Oct. 21, 1996, pp. 1–4.

"Performance Features", http://www.vast.co.za/Performance_features.html, Oct. 21, 1996, p. 1.

"What Can It Do?", http://www.vast.co.za/What_can_it_do.html, Oct. 21, 1996, p. 1.

"Unisys Exclusive Provider of Near–Real–Time USGA Championship Scores on the Web", May 29, 1996, hhtp://www.unisyscom/womens/sytechhtml, pp. 1–2.

"Electronic Yardage Systems Speed Up Play", Tim O'Connor The Financial Post, Golf Update, Jul. 12, 1996, p. 16 (copy submitted is identified as pp. 2–4).

(List continued on next page.)

*Primary Examiner*—Jessica Harrison
*Assistant Examiner*—Mark A. Sager
*Attorney, Agent, or Firm*—Merchant, Gould, Smith, Edell, Welter & Schmidt, P.A.

[57] ABSTRACT

The present invention is a computer-implemented method and system for selectively scoring and outputting the scores of a plurality of golf participants playing golf on a golf course using a computer system including a main computer. In accordance with the invention, a main computer, one or more remote computers and a communications network are provided. Each remote computer is associated with a hole on the golf course and coupled to the main computer via the communications network. Each remote computer receives a raw score for each golf participant playing the associated hole, calculates a local competition score for the associated hole for each golf participant based on the raw score for the golf participant, and communicates the raw scores to the host computer. Based on the raw scores communicated by each remote computer, the main computer calculates a competition score for each golf participant and communicates the competition scores to each remote computer.

63 Claims, 9 Drawing Sheets

Microfiche Appendix Included
(5 Microfiche, 454 Pages)

OTHER PUBLICATIONS

"PinMark Aims for the Green with Plan to Reduce Delays on the Golf Course", Jeff D Opdyke, The Wall Street Journal, Apr. 10, 1996.

"Building the First Internet Real–Time Golf Scoring System", by Mike Heck, http://www.unisys.com/womens/first/html, pp. 1–3.

"Hitting the Long Ball . . . ", http://www.unisys.com/womens/systech.html, pp. 1–3.

"Tournament Management System (GHIN® Compatible Version) Demonstration Disk and Tutorial Guide to Operations", produced by Star Plan Data Systems, ©1988–1995, 83 pages.

"A Software Toolkit for Fast and Reliable Data Transfer Over Wireless Data Networks", marketing material from Nettech Systems, 2 pages.

"The Nettech InstantRF™ family: Products Designed for the Best Possible Fit with Today's Wireless Data Communications Needs", marketing material from Nettech Systems, 2 pages.

"Nettech RFMLIB, Introducing Release 2 of Nettech RFMLIB . . . A Software Tool Kit for Development of Mobile Wireless Applications on the PC: One Universal API that Supports Most Popular Radio Modems", marketing material from Nettech Syhstems, 2 pages.

"Nettech RFGATE™, Nettech RFGATE is a Multi–Protocol Customizable Gateway that Allows Users of Portable Computers Equipped with Radio Modems to access Host Applications Over Wireless Data Networks.", marketing material from Nettech Systems, 2 pages.

"Nettech Product News, InstantRF® for CDPD and Cellular Data", marketing material from Nettech Systems, 1995; 2 pages.

"Advanced Communications Environment for Enterprise Mobility Version 2.0", Nettech RFexpress™, marketing material from Nettech Systems, 1995; 4 pages.

"Minnetonka Boat Works Don Shelby U.S. Invitational System Functional Design", prepared by Carol Cajacob et al., pp. 1–50.

"Interplay, Inc., The Future in Golf Is Here", marketing material from Interplay, Inc., 1 page.

"Sumner Golf Service Systems", by Sumner Incorporated, Bethesda, Maryland 20816, pp. 1–2.

"Golfnet™ Golfer Service Systems 1000 Clubs—425,000 Golfers—11 Years of Success!", by Sumner Incorporated, Bethesda, Maryland 20816, pp. 1–4.

"Functional Performance", http://www.vast.co.za/Functional_performance.html, pp. 1–2.

GOLF SCORING COMPUTER SYSTEM

In accordance with 37 C.F.R. Section 1.77(c)(2), a microfiche appendix of a computer program listing is included herewith. The microfiche appendix includes 5 microfiche and 454 frames. Copyright© 1996 Tournament Tracker, Inc.

FIELD OF THE INVENTION

The present invention relates generally to the game of golf, and more particularly, to a method and system for dynamically scoring a plurality of golf participants playing golf on a golf course.

BACKGROUND OF THE INVENTION

The game of golf is becoming a highly-competitive and spectator-oriented sport. Many golf clubs, both public and private, are hosting tournaments which often attract large audiences. Considerable time is spent by a tournament organizer, for example, a local golf professional, in preparing and running the tournament. Prior to starting a golf tournament, the organizer registers the players and creates player teams if a team-type competition is being played. During play, the golf players record their strokes for each hole. After play, the stroke scores are then provided to the tournament organizer for official scoring.

A variety of systems and devices exist to assist clubhouse professionals, golfers, and spectators in scoring, playing, and watching the game of golf. However, none of these systems provide a comprehensive tournament scoring and management system which facilitates creating, playing, watching and scoring of the tournaments.

For example, none of the prior art systems enable a tournament organizer to create complex scoring formats for the tournament, such as scoring formats varying from hole to hole because, for example, different participant scores are used at different holes or different tees are used by different participants at different holes. These systems also do not enable a tournament organizer to create a main tournament between teams of participants and a secondary tournament using a subset of the players in the main tournament, where a participant may be teamed with different participants in the main tournament and the secondary tournament.

Current systems and devices used to assist the golfers and/or tournament organizers in entering and processing the scores for players in a tournament cannot be readily adapted for use in the variety of circumstances presented by golf tournaments.

Accordingly, there exists a need for a method and system for dynamically scoring a plurality of golf participants on a golf course.

SUMMARY OF THE INVENTION

To overcome the limitations of current systems as described above, and to overcome other limitations that will become apparent upon reading and understanding the present specification, the present invention discloses a computer-implemented method and system for dynamically scoring a plurality of golf participants playing golf on a golf course using a computer system. In accordance with an exemplary embodiment of the invention, a main computer, one or more remote computers and a communications network are provided. Each remote computer is associated with a hole on the golf course and coupled to the main computer via the communications network. Each remote computer receives a raw score for each golf participant playing the associated hole, calculates a local competition score for the associated hole for each golf participant based on the raw score for the golf participant, and communicates the raw scores to the host computer. Based on the raw scores communicated by each remote computer, the main computer calculates a competition score for each golf individual participant and communicates the competition scores to each remote computer.

In accordance with another exemplary embodiment of the invention, a plurality of competitions of the golf participants are defined in the main computer and each of the competitions is assigned a scoring format. Each golf participant may be a member of one or more competitions. In addition, a golf participant may be teamed with one golf participant in a first competition and teamed with a different participant in a second competition.

In accordance with still another embodiment of the invention, each remote computer receives a raw score for each golf participant for its associated hole and communicates these raw scores to the main computer and the main computer selectively communicates these raw scores to the remote computers. For example, the raw scores may be communicated to some but not all of the remote computers and/or the raw scores may be formatted based on the type of the communications network being used. The communications network in one embodiment is a wireless communications network and the remote computers include solar panels to supplement their batteries.

These and various other advantages and features of the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there is illustrated and described specific exemplary embodiments of a system in accordance with the invention.

BRIEF DESCRIPTION OF THE DRAWINGS

Referring now to the drawings in which like reference numbers represent corresponding parts throughout.

DETAILED DESCRIPTION OF THE EMBODIMENTS

A portion of the disclosure of this patent document contains material which is subject to copyright protection.

The copyright owner has no objection to the facsimile reproduction by anyone of the patent disclosure, as it appears in the Patent and Trademark Office patent files or records, but otherwise reserves all copyright rights whatsoever.

In the following description of the exemplary embodiments, reference is made to the accompanying drawings and microfiche appendix which form a part hereof, and in which is shown by way of illustration specific embodiments in which the invention may be practiced. It is to be understood that other embodiments may be utilized as structural changes may be made without departing from the scope of the present invention.

Golf courses typically receive an entry fee from each golf player in a competition. To attract more golf players to more competitions, it is desirable to offer a wide variety of scoring methods for a competition. However, complex scoring methods, such as those which vary from hole to hole or those which allow different players on the same team to play from different tees, have been to cumbersome to create and score according to the rules of golf as set by the local golf association, for example the United States Golf Association (USGA). A complex scoring system, when used, typically deviates from the rules of golf so as to ease the scoring procedures.

As will be explained in detail below, aspects of the present invention overcome these problems and allows creation of complex scoring methods and scoring of competitions based on complex scoring methods according the rules of golf. For example, an aspect of the invention enables a golf tournament organizer to create and score multiple competitions within a main competition, and, further, to enable the golf tournament organizer to score each competition differently, to score each hole of each competition differently, and/or to team the participants differently in each competition.

To further enhance the appeal of the game of golf to the players and spectators, it is desirable to facilitate the playing and watching of the competition. Present systems which attempt such facilitation typically involve excessive overhead, for example too much time to set up or take down, or slow the play of the game. These disadvantages are overcome with other aspects of the present invention which provide a golf scoring computer system which is easy to setup and takedown and which also eliminates the need for many electrical cables, thereby freeing the golf course of obstacles and facilitating the playing and viewing of the game. Further aspects of the present invention reduce data processing time and data transmission so as to maximize the speed of the system while minimizing the costs associated with wireless data transmission.

Figure 1:
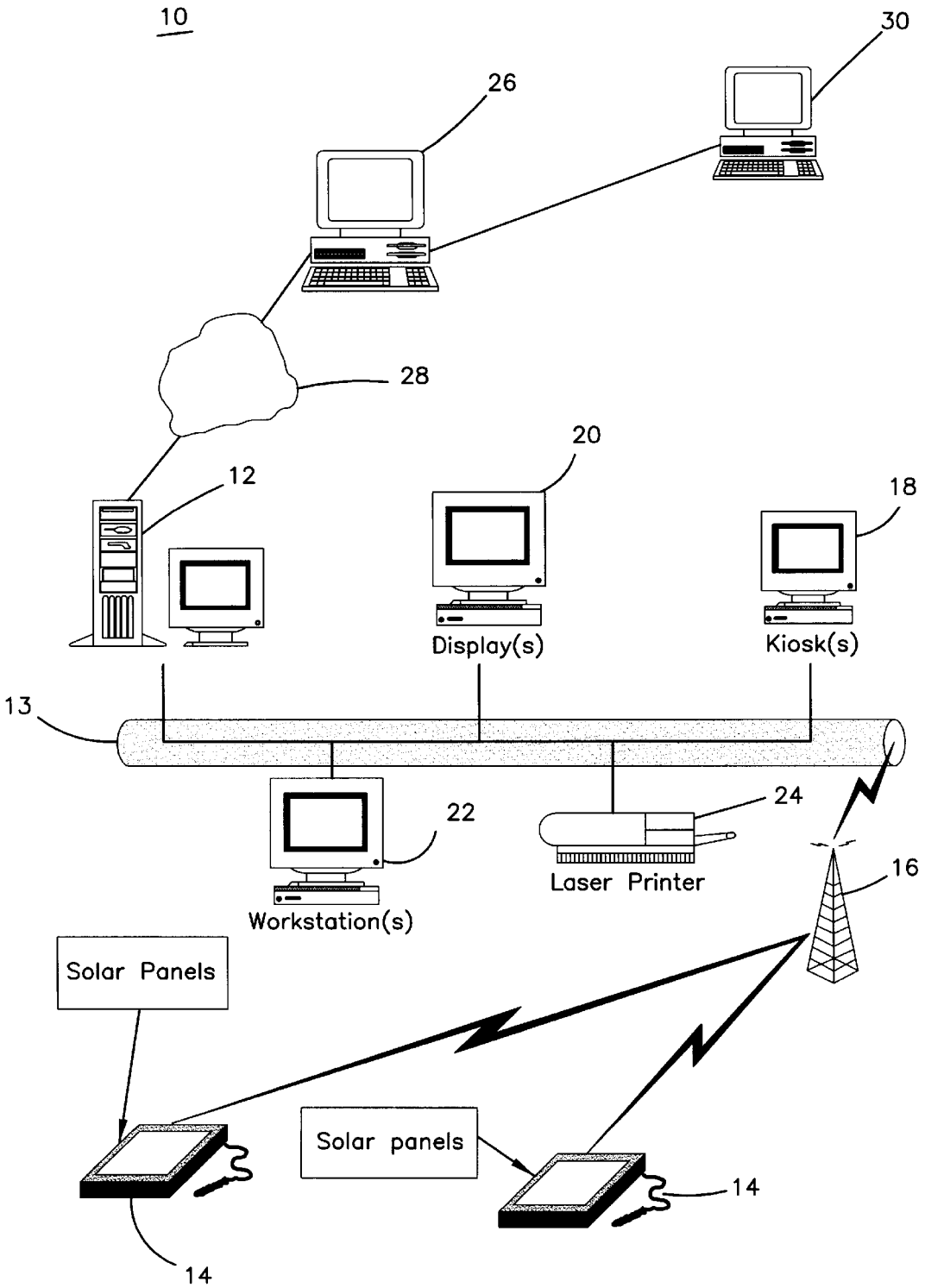
FIG. 1 is a block diagram illustrating an exemplary system in accordance with the principles of the present invention.

FIG. 1 is a block diagram which illustrates an exemplary system 10 for dynamically scoring golf competitions played between golf participants on a golf course in accordance with the principles of the present invention. For reference, a golf participant may be an individual golf player playing his/her own ball or a group of golf players playing the same ball. One or more participants may comprise a team. Each golf participant may have one raw score for each hole and one net score and one competition score for each hole for each competition in which the golf participant is involved. Furthermore, each team may have one team raw score for each hole and one team net score for each hole.

As will be appreciated by those skilled in the art, a raw score is the number of strokes taken in order to place a golf ball in a hole and a net score is a raw score adjusted for any handicap allowance. A competition score is a score for a hole which is based on the scoring method of the competition and the net scores and/or raw scores for the participant(s) of a team and a cumulative competition score is the sum of the competition scores for the holes which have been played by a team. A team raw score is the sum of the raw scores of all the participants on a team for a hole. A team net score is the sum of the net scores for all the participants on a team for a hole.

Broadly speaking, the exemplary system 10 includes a main computer 12 located, for example, at the golf course clubhouse, and coupled via a communications network 16 to remote computers 14 stationed at each hole of the golf course. The main computer 12 may be coupled, via a local area network 13, such as an Ethernet LAN, to one or more displays 20, such as a large screen television, one or more kiosks 18, one or more workstations 22, and/or one or more printers 24. The system 10 may further include a server computer 26 coupled to the main computer 12 for receiving, storing, and performing calculations on scoring data from the main computer 12 and main computers associated with other golf courses. As will be explained further hereinbelow, the server computer 26 may be connected to the internet 28, for example, to receive various requests from client computers 30.

The main computer 12 generally includes a central processing unit (CPU), a memory for storing computer programs and other data, and one or more data storage devices such as hard disk drives, floppy disk drives, and CD-ROM drives and their associated media. Also included are input devices such as keyboard and mouse pointing devices.

The main computer 12 operates under the control of an operating system, such as Windows, OS/2, Macintosh, UNIX, DOS, etc. The operating system as well as various software used to implement the invention may all be tangibly embodied in a computer-readable medium, e.g., one or more of the fixed and/or removable data storage devices and their associated media, which, under control of the operating system, may be loaded from the data storage device into the memory of the main computer 12 for use during actual operations. The source code of the software for the main computer 12 is attached in the microfiche appendix.

The main computer 12 is used to set up competitions between golf participants and to process scores for the golf participants. During setup, the main computer 12 receives input from a user, for example, a golf course professional, for defining a group of golf participants and assigning a scoring method to the group. The golf pro may further define subgroups consisting of a subset of the golf participants in the main group and assign each subgroup a unique scoring method. Thus, for example, the golf pro may create a main tournament or competition played under a first scoring format, e.g., individual stroke play, and one or more secondary tournaments or competitions each played under their own unique scoring method, for example, best ball of four stroke play. As will be explained hereinbelow, the scores for a competition may vary from hole-to-hole based on any hole-to-hole variations in the tees for the participants and in the scoring format for the competition.

It is noted that the use of the term "main" to describe the main computer 12 serves merely to distinguish the main computer 12 from the remote computers 14. It is not intended to imply that the main computer 12 is a more powerful, larger, or dominant computer relative to the remote computers 14, though it may be so. Moreover, as will be appreciated by those skilled in the art, some or all of the functions of the main computer 12 may be spread over two or more computers and/or the remote computers 14. In addition, the main computer 12 may be coupled with a database in which it may store data and from which it may retrieve data for use in implementing the present invention.

The remote computers 14 also include a CPU, a memory, and one or more data storage devices and operate under the control of an operating system. The operating system and software are tangibly embodied in a computer-readable medium and may be loaded into the memory of the remote computer 14 for use during actual operations. The source code of the software for the remote computers 14 is attached in the microfiche appendix.

Each of the remote computers 14 is associated with a particular hole on the golf course and receives each golf participant's raw score for that particular hole. In the exemplary embodiment, a remote computer 14 is positioned at each tee box for receiving raw scores from the golf participants for the previous hole. In this configuration, raw scores for the final hole, for example, the ninth or eighteenth hole, may be received by the main computer 12 or a remote computer at the tee box of hole 1.

The remote computers 14 also include one or more input devices and a display device. In the exemplary embodiment, the remote computers 14 include an interactive display screen which serves both as a display device and an input device. The interactive display screen may be used in conjunction with an electromagnetic pen and a bar code scanner. A traditional display monitor and keyboard may supplement or replace the interactive display screen.

The exemplary remote computers 14 include a Nickel-Cadmium or Nickel Metal Hydride battery as a power source thus enabling the system 10 to be used at any golf course, including those without electricity at tee boxes. These batteries provide a number of hours of operation. However, golf tournaments often last 8–12 hours, which is beyond the life of these batteries even using battery-conservation techniques. To extend battery-life, the remote computers 14 are provided with solar panels, such as the portable solar panels sold by Keep It Simple Systems of Helena, Mont. Of course, at tee boxes with electricity, the remote computers 14 may be powered by conventional AC power. Exemplary remote computers 14 include Telxon's PTC-1184 Pen-Based Computer, Apple's Newton-based Personal Digital Assistant (PDA), and Motorola's Marco PDA, as well as notebook-type computers.

As will be further described hereinbelow, each remote computer 14 communicates the raw scores which it receives to the main computer 12. The main computer 12 receives the raw scores for each participant as each hole is played and calculates competition scores, i.e., scores based on the scoring method associated with a competition. The competition scores are then selectively communicated to the remote computers 14 for near real-time or hole-by-hole display of the raw scores and the competition scores on the golf course as well as in the clubhouse.

In the exemplary embodiment depicted in FIG. 1, the communications network 16 comprises a wireless communications network. A hard-wired communications network may alternately be employed. The wireless communications network may be a wireless wide-area network (WWAN network), such as ARDIS or RAM, or a wireless local area network (WLAN network), such as an ARLAN690 WLAN network from Aironet or a Spectrum24 WLAN network from Symbol Technologies. The system 10 may also be used with other WWAN networks, such as PCS, satellite-based networks, or networks using cellular digital packet data) (CDPD) communications technology supported by cellular radio networks.

To communicate over the communications network 16, the system 10 includes both communications hardware and middleware for each remote computer 14 and the main computer 12. The middleware may include send and receive functions to enable the computers to send and receive data over the communications network 17. The communications hardware for the remote computers 14 and main computer 12 will vary with the communications network, but typically includes PCMCIA modems for the remote computers 14. The main computer 12 may include a serial modem coupled to the local public communications service when using a WWAN network, or one or more RF-, microwave-, or infrared-based access points, when using a WLAN network. The access points may also be powered by solar panels.

Most golf course will have access to at least one WWAN network provider, such as ARDIS or RAM. However, no one type of WWAN network provider services all regions. Thus, when using such networks, the system 10 provides middleware which operates substantially independent of the type of communications network by interfacing with a number of wireless communications networks. This facilitates use of the system 10 in any region serviced by wide-area networks. In regions covered by more than one such network, the golf course may choose a preferred network. Exemplary middleware includes Nettech Rflink from Nettech Systems and Mobile App Builder from Numina Systems Inc.

Though most golf courses will be able to choose between a WWAN network or a WLAN network, some rural areas or areas with rugged terrain are not covered by WWAN networks. However, these unserviced areas are often home to golf courses. In such areas, a private RF system, such as a wireless local area network may be used. However, the range of a single RF transmitter typically cannot cover an entire golf course. Accordingly, the present invention provides for access sites for extending the range of the private RF network when using private RF networks. The access sites may be strategically located throughout the golf course so that each remote computer lies within range of the network with the minimum number of access sites.

Using portable remote computers 14 and a wireless communications network allows for easy setup and takedown of the system 10 at a golf course. It further eliminates the need for many electrical cables thus freeing the golf course of obstacles and facilitating the playing and viewing of the game. However, the use of a wireless communications network involves some costs, including a typically slower data transmission rate and charges based on the amount of data transmitted when using wireless wide-area networks. As will become apparent hereinbelow, the present invention includes data processing and transmission techniques for minimizing the costs associated with wireless data transmission.

Figure 2:
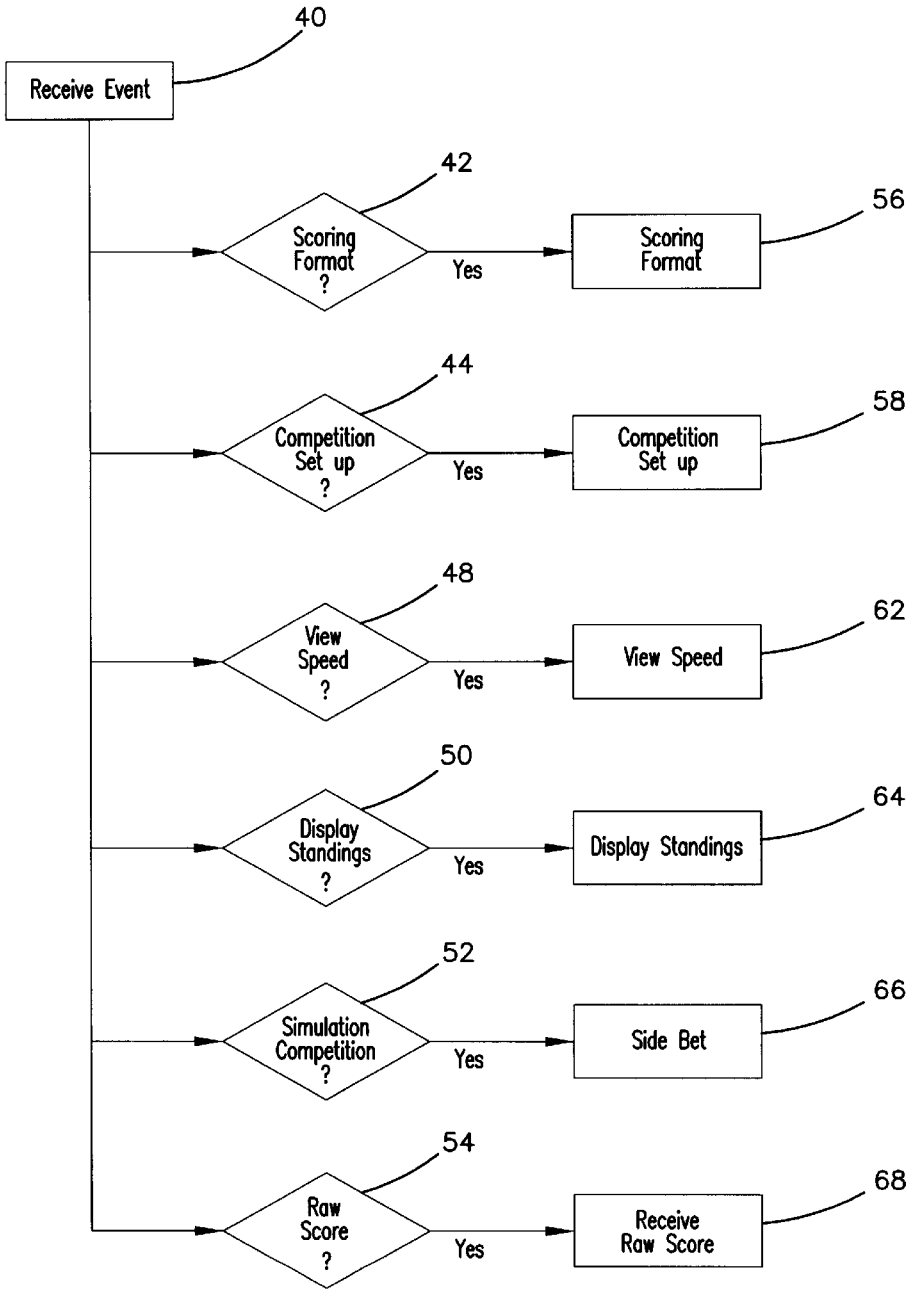
FIG. 2 is a flow chart illustrating a general overview of the steps performed with a main computer of the exemplary system.

FIG. 2 is a general diagram outlining the procedures performed with the main computer 12. Block 40 represents the main computer 12 waiting to receive an event. Upon the happening of an event, the type of event is determined as indicated by the decision diamonds 42–54 and control is passed to the appropriate routine designated by blocks 56–68. As will become apparent, some of the routines enable a user, e.g., the tournament organizer or club house professional, to set up competitions and are typically performed prior to the play of a tournament. Meanwhile, other routines are typically performed during or after tournament or competition play.

In general, when the main computer 12 receives a request from a user to create a scoring format at block 40, control is passed to a scoring format creation routine as indicated by decision diamond 42 and block 56. When the main computer 12 receives a request to set up a competition at block 40, control is passed to a competition creation routine as indicated by decision diamond 44 and block 58. When the main computer 12 receives a request to view the speed of play at block 40, control passes to a view speed of play routine as indicated by decision diamond 48 and block 62. When the main computer 12 receives a request to display standings of the competitions at block 40, control passes to a display standings routine as indicated by decision diamond 50 and block 64. When the main computer 12 receives a request to create and score a simulation competition at block 40, control passes to a simulation competition routine as indicated by decision diamond 52 and block 66. Finally, when the main computer 12 receives a raw score at block 40, control passes to a data processing routine as indicated by decision diamond 54 and block 68. The raw score may be received from a remote computer 14 or one or the input devices coupled to the main computer 12. Further details of the routines of blocks 56–68 will be described hereinafter.

Figure 3:
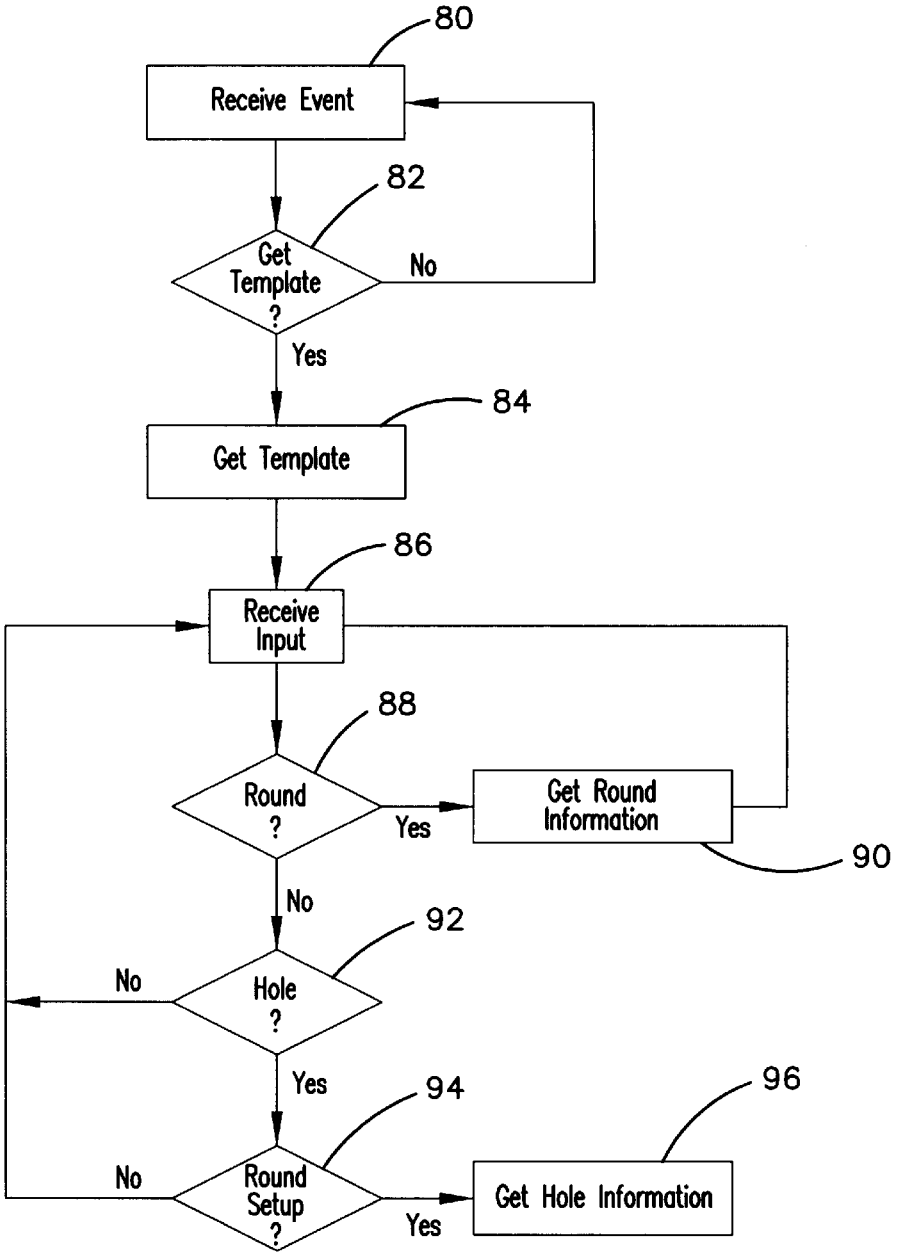
FIG. 3 is a flow chart illustrating the steps performed on the main computer for creating a scoring format.

FIG. 3 illustrates further details of the scoring format routine 44. The scoring format routine 44 enables a user to define, in the main computer 12, parameters for a round of golf, including parameters for each hole of the round. Block 80 represents the main computer 12 receiving an event or request from the user. Once an event has been received, control is passed to decision diamond 82 to identify the event and respond accordingly.

Decision diamond 82 represents the main computer 12 determining whether it received a request from the user to retrieve a scoring format template for editing. The user request may be a request to retrieve a new scoring format template from memory or to retrieve an existing scoring format from memory for use as a template. If a retrieve request is received, the main computer 12 retrieves and displays a scoring format template for editing by the user as indicated by block 84.

After an new or existing scoring format template is retrieved and displayed for editing, the main computer 12 receives a user input indicating whether to define parameters for a round or a hole of the round, as indicated at block 86. Decision diamond 88 represents the main computer 12 determining whether it received a request to define parameters for a round. If so, control moves to block 90 where the main computer 12 receives user inputs defining the parameters for the round. The user may, for example, define the following round parameters for the scoring format:

- name and description of the scoring format;
- the number of holes in the round;
- the number of golf players per team (1 or more);
- whether the team will play stroke or match play;
- the number of raw scores to be used for scoring the team; and
- the percentage of the tournament handicap to use for the men, women, and mixed teams.

It should be appreciated that the number of raw scores to be used for scoring cannot be greater than the number of golf players on the team. Furthermore, the number of raw scores used determines whether any golf players will be paired, that is, share the same ball.

For example, if the scoring format requires four golf players per team and only two gross raw scores are to be used, the user may define which golf players are paired, i.e., play the same ball. Thus, the raw scores entered at the remote computer may be raw scores for a group of golf players or for an individual golf player. To avoid confusion, the player or players sharing the same ball for raw scoring will be referred to herein as a golf participant.

To set the pairings, the user defines pairing parameters which indicate how the players are paired. For example, for teams of four players comprising two participants each, the players may be grouped into four tiers A, B, C, and D and each team may have one player from each tier, as will be illustrated hereinbelow. The pairing parameters may be set such that the players are, for example, paired AB and CD.

If the user defines the scoring format to include match play scoring, then the main computer 12 receives from the user the type of match play scoring, such as match play scoring against another team, against par, or a special method of match play scoring, such as Chapman or Pinehurst match play. In match play between teams, which teams play one another may be defined subsequently during competition setup.

Decision diamond 92 represents the main computer 12 determining whether it received a request from the user to set up the holes for the scoring format. If so, control moves to decision diamond 94 where the main computer 12 determines whether a round has been previously set up. If not, control reverts to block 86; otherwise, control moves to block 96 where the main computer 12 receives user inputs defining the parameters of each hole.

For each hole, the user may define the number of raw scores and/or the number of net scores to sum for the competition score for each team. The number of raw or net scores to sum for a team however may be no greater than the number of golf participants on the team.

For example, where a team comprises four players each playing their own ball, the user may define that two raw scores and one net score will be summed, in which case the best two of the four raw scores and the best net score of the four net scores is used. If the scoring is stroke play then these three scores are summed for a determining a competition score for the team. In match scoring, the two raw scores and one net score, combined or separately, are compared to the scores of another team or against par to determine a competition score for the team.

The user may further define which player's or players'net raw scores or gross raw scores must be summed for each hole. For example, the user may define that the net or gross raw score from one or more particular golf players must be summed for the particular hole or that the net or gross raw scores of a certain number of professionals, juniors, seniors, males, or females must be summed for a particular hole. In this manner the user may set up a scoring format which varies from hole to hole as to how many and which golf player's raw scores are to be used for scoring for the hole.

Figure 4:
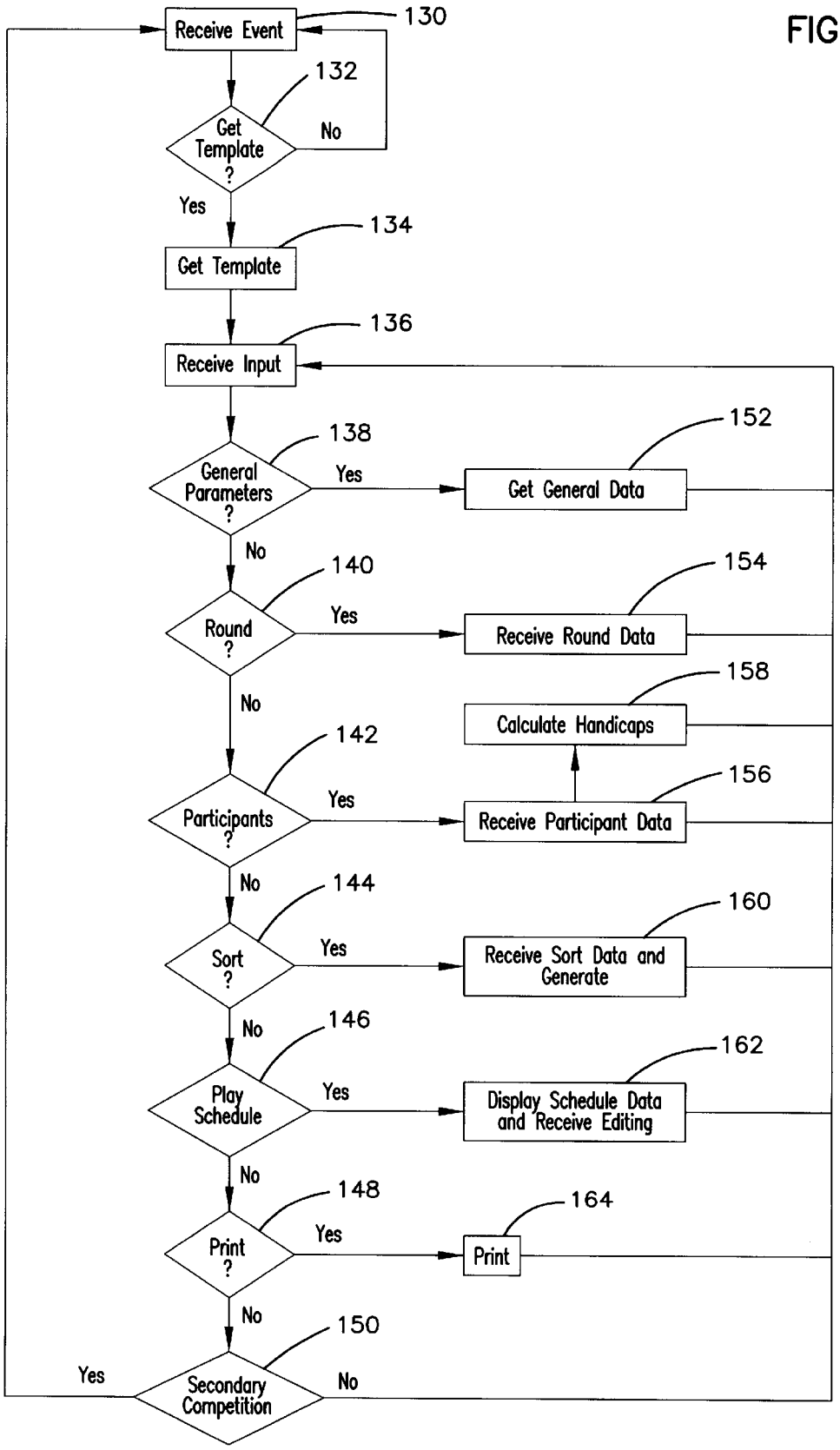
FIG. 4 is a flow chart illustrating the steps performed on the main computer for creating a competition.

FIG. 4 illustrates further details of the competition set-up routine 58 for setting up competitions between golf participants. The competition set-up routine 58 enables a golf course professional or other user to create one or more main competitions between golf participants and assign each with a unique scoring format. Furthermore, for each main competition, the user may create one or more secondary competitions between a subset of the golf participants in a main competition and assign each secondary competitions with a unique scoring method that differs from the main competition and/or any other secondary competition. As a result, a golf course may create and score a main tournament according to one scoring format, and may create and simultaneously score subtournaments of the main tournament based on different scoring formats and/or different team compositions.

The competition set up routine 58 will first be illustrated with reference to the creation of a main competition followed by the creation of a secondary competition. Block 130 represents the main computer 12 receiving a request from the user. Once a request has been received, control is passed to decision diamond 132 to identify the event and respond accordingly.

Decision diamond 132 represents the main computer 12 determining whether it received a request from the user to retrieve a competition template for editing. The user request may be a request to retrieve a new competition template from memory or to retrieve an existing competition from memory for use as a template. If a retrieve request is received, the main computer 12 retrieves and displays a competition template for editing by the user as indicated by block 134.

After an new or existing competition template is retrieved and displayed for editing, the main computer 12 receives user inputs defining the parameters of the competition and stores the input in memory. Block 136 represents the main computer 12 receiving a request from the user. Decision diamonds 138–150 represent the main computer 12 identifying the request and responding accordingly.

Decision diamond 138 represents the main computer 12 determining whether it received a request to set up general parameters for the competition. If so, the main computer 12 receives general parameter information from the user as indicated by block 152. The user may, for example, define in the main computer 12, the following general parameters for the main competition:

the competition name;

the number of rounds in the competition;

the number flights in the competition;

the date and starting time of the competition;

the type (men's, women's, mixed) of the competition; and special scoring methods for the competition.

The special scoring methods include the following: skin scoring for each participant based on net score; skin scoring for each participant based on raw score; skin scoring for each team based on net score; skin scoring for each team based on raw score; participant scoring based on net score; participant scoring based on raw score; team scoring based on the sum of the net scores for the participant(s) on a team; and team scoring based on the sum of the raw scores for the participant(s) on a team. The user may further designate the skin scoring to be either fixed scoring or carry over scoring.

Decision diamond 140 represents the main computer 12 determining whether it received a request to set up a round of the main competition. If so, block 154 represents the main computer 12 receiving scoring information for the round from the user. For each round of the main competition, the main computer 12 may, for example, receive the following information from the user:

a scoring format for the round the course and default tees for the round;

the specific tees for each player for each hole of the round;

the special scoring for the round;

the maximum and minimum handicap for the round; and cut threshold information for main competitions of more than one round, including the number to be cut after the round and/or the number within a certain strokes from the lead.

To define the scoring format for the round of the main computer 12, the user may select a scoring format from a list of scoring formats previously created using the scoring format creation routine 56. Optionally, the user may create a new scoring format or modify an existing scoring format, in which case the control moves to block 98 and the steps for creating a scoring format are performed. It is noted that the scoring format for the first round of the competition may limit the scoring formats of later rounds. For example, the players on a team must be consistent from round to round. However, within a team, the participants may be paired differently from round to round. For example, a team of four players A, B, C, D may comprise participants AB and CD in round one and participants AC and BD in round two.

Regarding the course and tee information for each round, typically a country club has a number of golf courses, for example, an executive 18 holes, a main 18 holes, and executive back 9 holes, etc. Each of these holes is typically associated with one, two, or more tees, typically designated by color, for example a white tee, a yellow tee or a blue tee. For each round, the main computer 12 receives information as to which course will be played, and which default tees will be used for the men and which default tees will be used for the women. The user may also provide information as to which tees will be used by each player at the hole level.

Decision diamond 142 represents the main computer determining whether a request to set up the golf participants for the main competition has been received. If so, block 156 represents the main computer 12 receiving golf participant data.

During set up of a main competition, this step includes, the main computer 12 displaying a list of the names of all of the golf players, e.g., country club members, that the user can select for the main competition. To display the list, the main computer 12 retrieves from its memory names and attributes, such as USGA handicap index, cart/caddie preference, gender, and status, e.g., professional, amateur, or junior for each member. The names and attributes of the members may be predefined in the main computer 12.

The user then selects the members for the tournament. The selection of each member results in the player name as well as the player attributes being stored in the memory of the main computer 12 and associated with the tournament. If desired, the user may modify a player's attributes. The user may also modify the specific tees used by a player at the hole level. In addition, the name and attributes of golfers who are not members of the country club, e.g., new members or guests, may be entered into the main computer 12 for storage thereby.

Next, at block 158, a player tournament handicap is calculated for each player based on the tee information and their USGA handicap index. An exemplary method of calculating the player tournament handicap is illustrated below.

Decision diamond 144 represents the main computer determining whether it received a sort request. If so, block 160 represents the main computer 12 receiving sort information from the user, which may, for example, include the following:

pre-sort men and women separately;

sort by player tournament handicap using USGA handicap as tie-breaker;

sort with randomization; and sort with cart/caddie preference; or no sort.

Based on the sort information, the main computer 12 generates tee groups, e.g., foursomes, as well as starting tees and tee times. If the scoring format requires teams of two or more players, these teams may be generated by sorting the players into tiers based on the number of players per team for the scoring format and then generating teams consisting of one player from each tier. In addition, if the scoring format requires that two or more players be paired, the main computer 12 may generate the pairings by pairing a player from one tier with a player from another tier based on the pairing parameters associated with the selected scoring format. An exemplary sort procedure will be illustrated hereinbelow.

If the user opts not to sort the players, the main computer 12 generates tee groups, teams, and participants based on the entry of the players. For example, for teams of four players, the first four players entered form team one, the second four players entered form team two, etc. Within each team the first player is designated the tier A player, the second player the tier B player, etc.

Also, at block 160, a participant tournament handicap for each participant is calculated and allocated across the holes per USGA guidelines. For participants of single players, the participant tournament handicap will equal the player tournament handicap. For participants of multiple players, the participant tournament handicap may be, for example, the average of the player tournament handicaps for the players of a participant or the sum of a scaled version of each player's player tournament handicap.

Decision diamond 146 represents the main computer 12 determining whether it received a request to view and edit play scheduling. If so, block 162 represents the main computer 12 displaying the following data: tee groups, teams, tee times, and starting tees. The main computer 12 may then receive user inputs editing the data so that the user can manually arrange the players in a tee group and/or team as well as the starting tee and tee time for a tee group or team. This step includes the main computer 12 receiving user inputs designating which teams play one another if match play scoring against another team is being used.

For the second or later rounds, the user may define the tee groups, tee times and starting tees for the round. However, as mentioned earlier, the composition of the team is determined by the first round and cannot be changed.

Decision diamond 148 represents the main computer 12 determining whether it received a print request. If so, block 164 represents the main computer 12 prints user-requested information using the printer 24. For example, the user may request printing of team/tee group listings for the tournament, scorecards for each team, cart cards, tee times, and a listing of the players including for each player, a name, a USGA handicap index, a course handicap, and tournament handicap.

Once a main competition has been defined, the user may define a secondary competition between a subset of the participants, i.e., the players/paired players, of the main competition. Decision diamond 150 represents the main computer 12 determining whether a request to set up a secondary competition has been received. If so control passes to block 136 and the steps for defining the parameters of a competition are retraced. However, as should be appreciated, the secondary competition(s) will share common parameters with its parent, main competition, such as tee groups, times, etc.

The set up of a secondary competition will be described with reference to blocks 152–164 and the parameter data received thereat. At block 152, the main computer receives the name of the secondary competition, the type (men's, women's, mixed) of the secondary competition, the number of rounds of the secondary competition, and the special scoring for the secondary competition. Parameters such as the start date and time do not vary between the secondary competition and the initial group. In addition, each round of the secondary competition is mapped back to a round of the main competition and thus the number of rounds of the secondary competition cannot be greater than the number of rounds in the main competition.

At block 154, the main computer 12 receives a scoring format for the secondary competition. The scoring format for the secondary competition may be selected or created by the user. Similar to the scoring format used for the main competition, the scoring format for the secondary competition may require one or more participants per team. However, the type of scoring format that can be used is constrained as the secondary competition must be scored using the raw scores of the participants in the main competition. In other words, though the participants may be reteamed, the participants cannot be paired together for playing one ball.

The main computer 12 may also receive the maximum and minimum handicap for the secondary competition as well as cut threshold information for the secondary competition. Course and tee information are not received by the main computer 12 as these parameters are shared with the main competition.

At block 156, the main computer receives the participant information for the secondary competition. This step includes the main computer 12 displaying a list of the participants in the main competition for selection by the user for the secondary competition. The participant list may be a listing of paired groups of players or individual golf players depending on how raw scores are entered for the main competition. For example, if individual raw scores are entered, then the participant list includes every golf player. If the players are paired so one raw score is entered for the pair, the participant list comprises each player pairing.

At block 160, the main computer 12 receives sorting instructions, for example, no sort, pre-sort men and women separately, or randomization. If required by the scoring format and indicated by the sort instructions, the main computer 12 may then generate multiple participant teams.

At block 162, the main computer 12 receives play scheduling information, such as the composition of the teams. However, tee information, i.e., tee groups, starting tees and times, is dictated by the main competition. Specifically, if the scoring format requires multiple-participant teams, the user may define these teams if none were generated at step 160 or may redefine the multiple-participant teams generated at step 160. In this manner, a golf participant may be teamed with another golf participant in the main competitions and not teamed with that participant in the secondary competition. In addition, a participant may be on a team with a participant teeing from a different hole with a different tee group.

Step 160 further includes the calculation of tournament handicaps for each participant and each team in the secondary competition. Though the participants remain the same between the main and secondary competitions, a new participant tournament handicap is calculated for each participant and allocated across the holes as handicap percentages may differ between scoring formats.

After the main competition and all secondary competitions are set up, tournament data, such as scoring tables, participant and team identifying data, and handicap data, is downloaded, for example by transmission over the communications network or a storage device, such as a floppy disk, to the remote computers 14 for use thereby in scoring the competitions.

Figure 5:
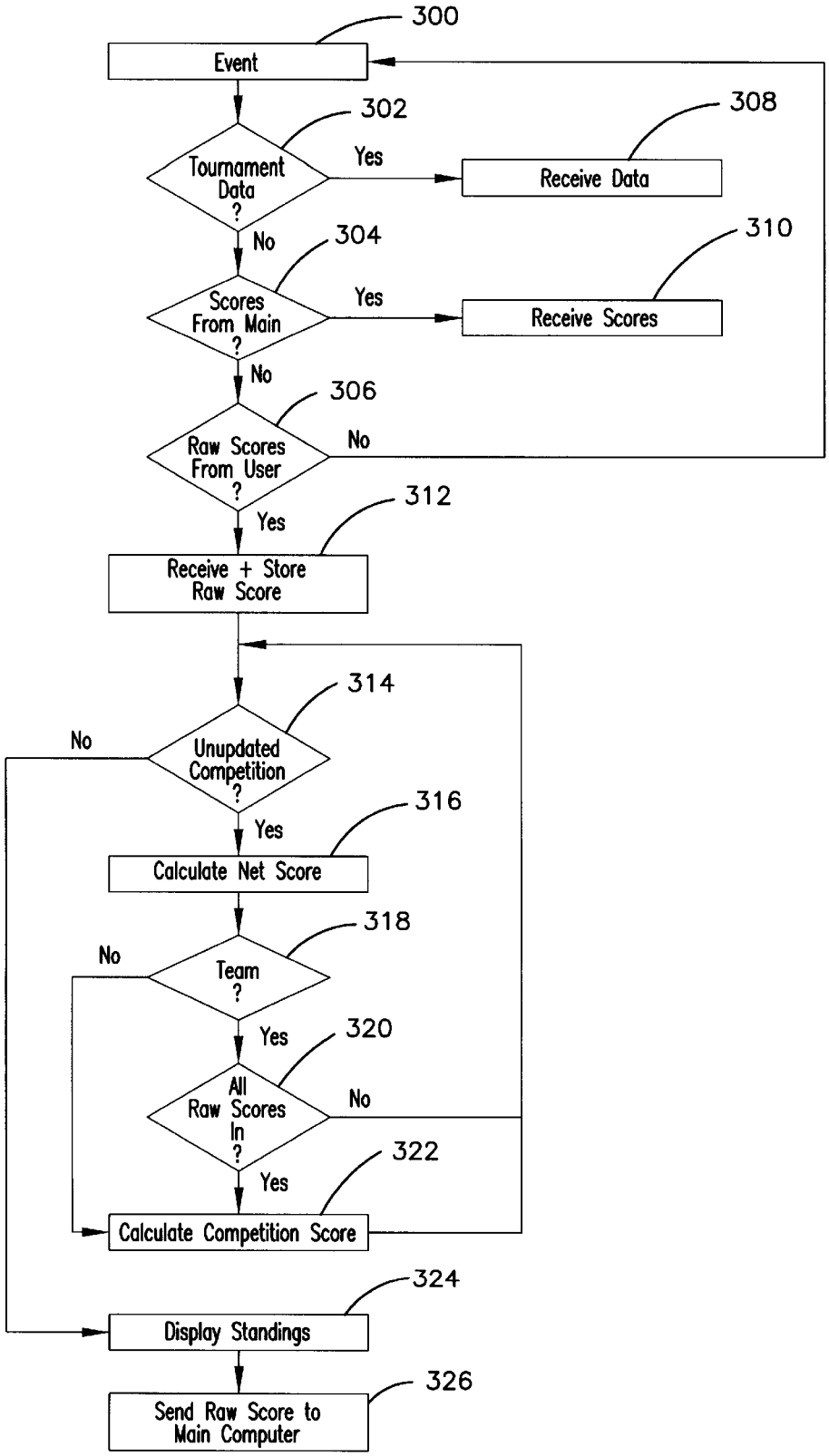
FIG. 5 is a flow chart illustrating the steps performed by each remote computer in processing scores for the golf participants.

FIG. 5 is a flow chart of the steps performed by the remote computers 14 in the exemplary embodiment of the present invention. Block 300 represents a remote computer 14 receiving an event. Decision diamonds 302–306 represent the remote computer 14, identifying the event and responding accordingly.

Block 308 represents the remote computer 14 receiving the tournament data from the main computer 14. Block 310 represents the remote computer 14 receiving and storing score data from the main computer. The score data may include raw scores from other remote computers 14, competition scores, and/or cumulative competition scores, as will be discussed further below.

Block 312 represents the remote computer receiving a raw score for a participant. The step includes receiving participant identification from a player, for example, by scanning an id card or entering an identification number, displaying a team scorecard for proper input of the raw score, and storing the participant's raw score in the memory of the remote computer 14.

Blocks 314–328 represent the remote computer 14 calculating a net score, a competition score, and a cumulative competition score for each participant for each competition in which the participant is playing. These steps may also include the remote computer 14 calculating scores for any special scoring methods for each competition.

To calculate the net scores and competition scores, the remote computer 14 loops through the following steps for each competition. First, the remote computer 14 determines whether a competition has not been updated with scores, as indicated by decision diamond 314. If so, the remote computer 14 identifies a nonupdated competition, retrieves the scoring format assigned to the identified competition, and calculates a net score for the participant for the identified competition, as indicated at block 316. The net score is stored in the memory of the remote computer 14.

Next, the remote computer determines whether the participant is a member of a team with more than one participant or whether the participant is a member of a team competing against another team in match play, as indicated by decision diamond 318. If not, then a competition score is calculated based on the scoring format for the particular hole and stored in the memory of the remote computer 14, as indicated by block 322. A cumulative competition score may also be calculated and stored in memory at block 322.

Otherwise, the remote computer 14 then checks if the raw scores needed for the other participant(s) have been entered, as indicated by decision diamond 320. If the needed raw scores have been entered, then the remote computer 14 calculates a competition score for the participant and stores the competition score in its memory, as indicated by block 322.

If the needed raw scores have not been entered, the remote computer 14 bypasses calculating a competition score and returns to decision diamond 314, as indicated by decision diamond 320. The competition scores for the participant which are bypassed will be calculated when all of the raw scores for the other participant(s) have been entered. It should be appreciated that one or more participants may share a competition score if the participants are members of the same team.

Once the remote computer has cycled through all of the competitions and calculated the net scores and competition scores for each competition if possible, the remote computer 14 displays the standings for the main competition, as indicated by decision diamond 314 and block 324. The player or team at this point may scroll through the cumulative competition scoring standings of any of the competitions, and may also view cumulative, raw and net scores for the participants and teams who have played the hole.

While displaying the standings, the remote computer 14 communicates the raw score(s) for the participant(s) to the main computer 12, as indicated by block 326. Each raw score is typically packaged in a data structure including the address of the main computer 14 and a message including the raw score, a hole identifier, and a participant identifier. It is noted that there may be two participant identifiers for a participant. A larger, universal identifier which is unique for a participant across all competitions defined in the main computer 12, and a second, smaller identifier which is unique for the participant across all competitions in play at a particular time. The smaller participant identifier is used for data transmission to decrease the amount of data transmitted.

This communication step includes the remote computer 14 determining the type of communications network 16 and formatting the communicated data in accordance with the communications network 16 protocol. For example, when using a WWAN network, the remote computer 14 first determines the type of communications network 16 being used by reading a variable in a table or file indicative of the type of communications network 16 being used. This variable may be changed when a golf course switches communications networks 16.

Next, the remote computer 14 sends a string representing the address of the main computer 12 to an address conversion function of the middleware, which formats the address according to the protocol of the communications network 16 being used, for example, a hexadecimal or decimal format. The formatted address and the message are then communicated over the communications network 16 by calling a send function of the middleware.

In other embodiments the remote computer may wait a certain period of time before communicating the raw score. For example, the remote computer 14 may wait until a time-out feature, such as one signifying the touch screen display of remote computer 14 has not received an input within a certain period of time, has elapsed.

Figure 6:
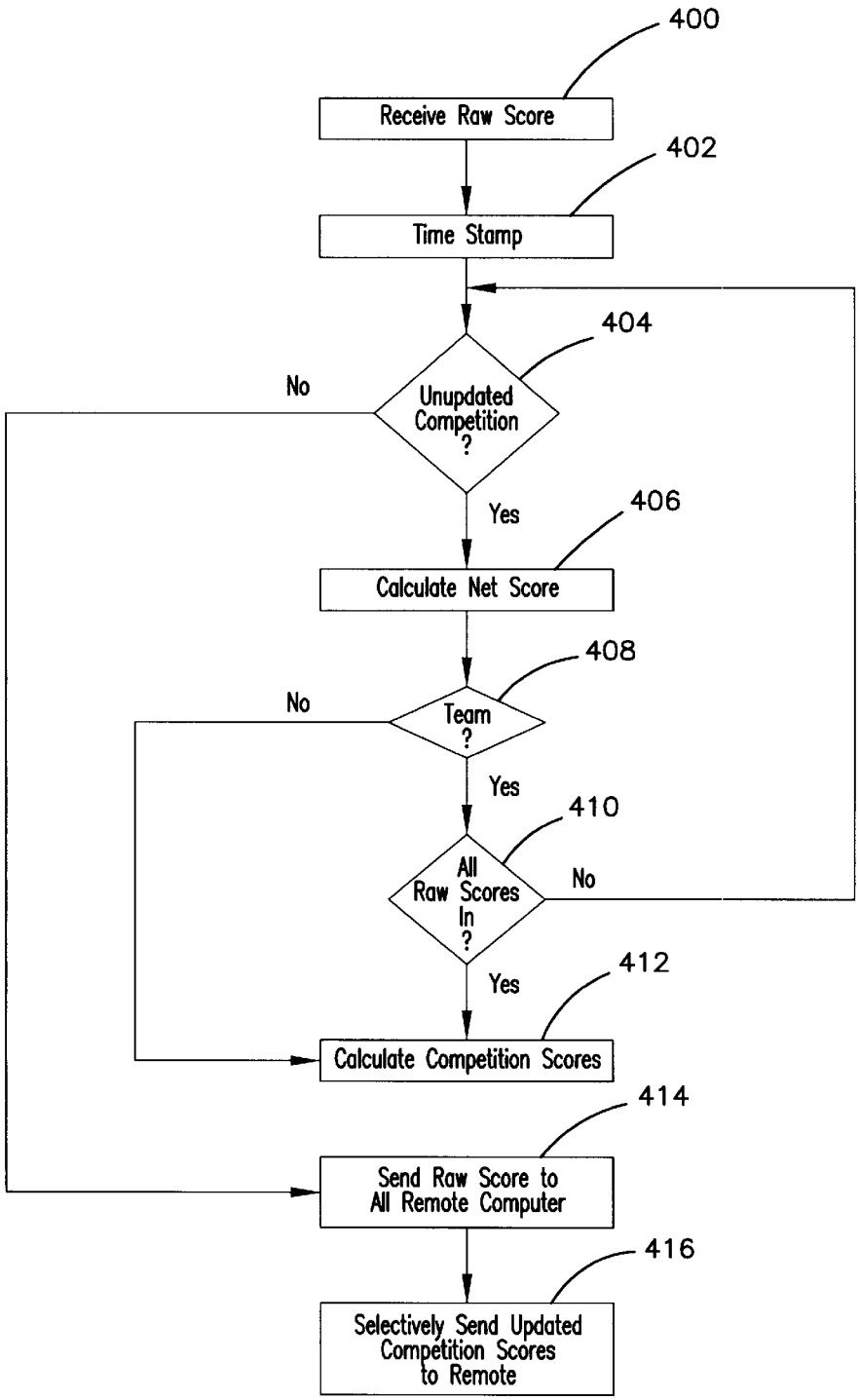
FIG. 6 is a flow chart illustrating the steps performed by the main computer in processing scores for the golf participants.
Figure 7:
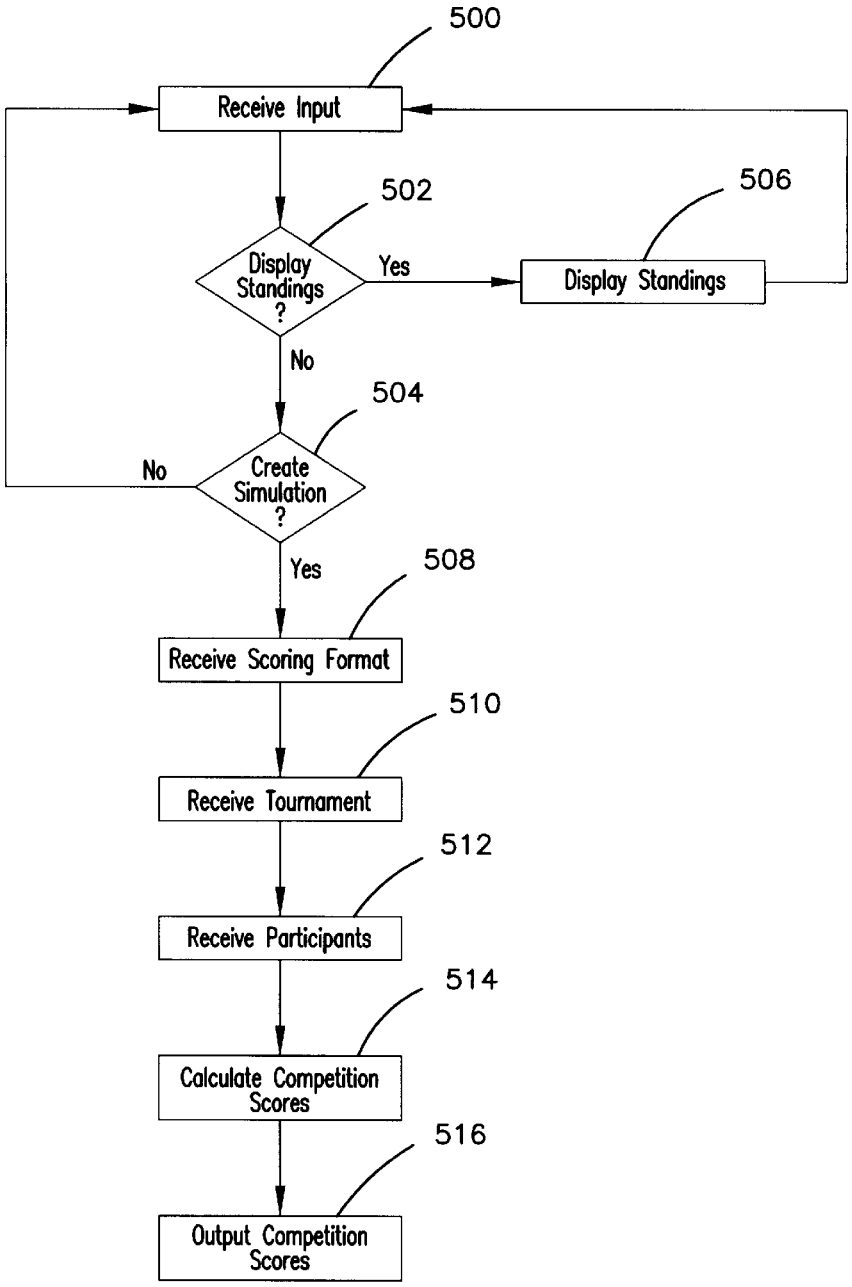
FIG. 7 is a flow chart illustrating the steps performed with a kiosk for creating and scoring a simulation competition.

FIG. 6 is a flow chart of the steps performed by the main computer 12 in processing the raw scores of the golf participants in the exemplary embodiment of the present invention. Block 400 represents the main computer receiving a raw score from a remote computer 14 or from one of the input devices of the main computer 12. This step includes storing the raw score in the memory of the main computer 12 in accordance with the identifiers.

Block 402 represents the main computer 12 time-stamping the raw score. The time stamp may then be used to determine the speed of play of the participant.

Blocks 404–412 represent the main computer 12 calculating a net score, a competition score, and a cumulative competition score for each competition in which the participant is playing. These steps may also include the main computer 12 calculating scores for any special scoring methods for each competition.

The main computer 12 loops through the following steps for each competition. First, the main computer 12 determines whether a competition has not been updated with scores, as indicated by decision diamond 404. If so, the main computer 12 identifies a nonupdated competition, retrieves the scoring format assigned to the identified competition, and calculates a net score for the participant for the identified competition, as indicated at block 406. The net score is stored in the memory of the main computer 12.

Next, the main computer 12 determines whether the participant is a member of a team with more than one participant or whether the participant is a member of a team competing against another team, as indicated by decision diamond 408. If not, then a competition score is calculated based on the scoring format for the particular hole and stored in the memory of the main computer 12, as indicated by block 412. A cumulative competition score may also be calculated and stored in memory at block 412.

Otherwise, the main computer 12 checks if the raw scores needed for the other participant(s) have been entered, as indicated by decision diamond 410. If the needed raw scores have been entered, then the main computer 12 calculates a competition score for the golf participant and stores the competition score in its memory, as indicated by block 412.

If all of the needed raw scores have not been entered, the main computer 12 bypasses the calculation of a competition score and cumulative score and returns to decision diamond 404, as indicated by decision diamond 410. The competition scores for the participant which are bypassed will be calculated when all of the raw scores for the other participant(s) have been entered.

Once the main computer 12 has cycled through all of the competitions and calculated the scores for each competition if possible, scoring data for the participant is selectively communicated to the remote computers 14, as indicated by decision diamond 404 and blocks 414 and 416. This step includes packaging the scoring data in a data structure having the appropriate remote computer 14 address, identifiers, and scoring data. This step further includes the main computer 12 determining the type of communications network 16 and formatting the communicated data in accordance with the communications network 16 protocol in a similar manner as discussed above with respect to the remote computers 14.

In the exemplary embodiment, the competition scores for the participant are sent to each remote computer 14 and the raw score for the participant is selectively sent to a subset of the remote computers 14. The remote computers 14 may receive the scores by calling a receive function of their middleware.

Specifically, the raw score is communicated only to each of the remote computers 14 which have not received a raw score for the participant, i.e., to the remote computers 14 associated with holes not yet played by the golf participant. Thus, when a remote computer 14 receives a raw score, it calculates a local competition score, sends the raw score to the main computer 12, and then receives a new competition score calculated by main computer 12. The new competition score is stored and replaces the local competition score.

This allows a local competition score to be immediately displayed to the player entering the raw score to speed play of the game and also provides a universal competition score to each remote computer 14 in case a remote computer 14 is improperly calculating local competition scores, for example, because of poor transmission of raw scores or errors in software. From the competition scores, each remote computer 14 may calculate the cumulative competition scores.

Thus, in the exemplary embodiment, at the end of a round of golf where all teams start at tee 1, the remote computers 14 will store the scoring data as indicated in Table 1 below.

TABLE 1

| Tee 2 | Tee 3 | Tee 4 | Tee 5 | Tee 6 | Tee 7 | Tee 8 | Tee 9 | Tee 10 |
|---|---|---|---|---|---|---|---|---|
| Raw-1<br>Net1<br>C1–18<br>CC | Raw1–2<br>Net1–2<br>C1–18<br>CC | Raw1–3<br>Net1–3<br>C1–18<br>CC | Raw1–4<br>Net1–4<br>C1–18<br>CC | Raw1–5<br>Net1–5<br>C1–18<br>CC | Raw1–6<br>Net1–6<br>C1–18<br>CC | Raw1–7<br>Net1–7<br>C1–18<br>CC | Raw1–8<br>Net1–8<br>C1–18<br>CC | Raw1–9<br>Net1–9<br>C1–18<br>CC |
| **Tee 11** | **Tee 12** | **Tee 13** | **Tee 14** | **Tee 15** | **Tee 16** | **Tee 17** | **Tee 18** | **Tee 1** |
| Raw1–10<br>Net1–10<br>C1–18<br>CC | Raw1–11<br>Net1–11<br>C1–18<br>CC | Raw1–12<br>Net1–12<br>C1–18<br>CC | Raw1–13<br>Net1–13<br>C1–18<br>CC | Raw1–14<br>Net1–14<br>C1–18<br>CC | Raw1–15<br>Net1–15<br>C1–18<br>CC | Raw1–16<br>Net1–16<br>C1–18<br>CC | Raw1–17<br>Net1–17<br>C1–18<br>CC | Raw1–18<br>Net1–18<br>C1–18<br>CC |

For reference, Raw1-X refers to raw scores for holes 1 through X, Net1-X refers to net scores for holes 1-X, C1-X refers to competition scores for holes 1-X, and CC refers to cumulative competition scores.

By providing data in this manner, a spectator or golfer may request any remote computer 14 to display the most recent cumulative scoring standings in any of the current competitions. A participant may also view its current raw and net scores prior to playing a hole. In addition, raw and net scores for the previous hole for all participants may be displayed. For example, at tee 3, a participant enters its raw score for hole 2, and will be able to scroll through a listing of the raw or net scores for every other participant who has played hole 2 and also see the highest, lowest and average raw, net or competition scores for hole 2.

In alternate embodiments, the raw score for the golf participant may be communicated only to each of the remote computers which have not received a raw score for the one golf participant and to the remote computer 14 which received a raw score for the golf participant immediately before the originating remote computer 14, i.e., the remote computer 14 associated with the previous hole played. For example, the raw scores received by a remote computer 12 for hole 9 are communicated to the main computer 12 which communicates the hole 9 raw scores to the remote computers associated with holes 8 and 10–18, assuming there are eighteen holes each associated with a remote computer 14. This allows a participant to view the scores for the hole being played and the upcoming hole.

Alternatively, the raw score for the golf participant may be communicated to all of the remote computers save the remote computer 14 which initially received the raw score.

Which data transfer method is most efficient depends on the number of competitions player as will be illustrated with reference to Tables 2 and 3 below. For example, consider an 18 hole competition with 25 teams of 4 participants with no secondary competitions, where ten characters (participantid (6), holeid(2) and score(2)) are sent as the raw score, eight characters (teamid(4), holeid(2), score(2)) are sent as the competition score, and nine characters (teamid(4), holes completed(2), score(3)) are sent as the cumulative competition score.

In the exemplary embodiment, where the raw scores are sent only to upcoming remote computers 14 and the competition scores are sent to each remote computer 14, 235,800 data characters will be transmitted between the main computer 12 and the remote computers 14, as shown in Table 2. This is based on each participant sending 18 raw scores to the main computer 12; the main computer sending a total of 153 (17+16+ . . . +2+1) raw scores to the remote computers 14 for each participant; and the main computer 12 sending 324 competition scores for every team.

TABLE 2

| Direction | Type | Length | # of Players | # of Teams | Times Sent | Total |
|---|---|---|---|---|---|---|
| Remote –> Main | Raw | 10 | 100 | | 18 | 18,000 |
| Main –> Remote | Raw | 10 | 100 | | 153 | 153,000 |
| Main –> Remote | Comp | 8 | | 25 | 324 | 64,800 |
| Main –> Remote | Cum | 9 | | | 0 | 0 |
| TOTAL | | | | | | 235,800 |

Where the raw scores and cumulative competition scores are transmitted to each remote computer, 324,000 data characters are transmitted, as shown in table 3 below.

TABLE 3

| Direction | Type | Length | # of Players | # of Teams | Times Sent | Total |
|---|---|---|---|---|---|---|
| Remote –> Main | Raw | 10 | 100 | | 18 | 18,000 |
| Main –> Remote | Raw | 10 | 100 | | 306 | 306,000 |
| TOTAL | | | | | | 324,000 |

Thus, the former method results in a substantial reduction of the amount of data transmitted over the communications network 16 as compared to the latter method. However, with secondary competitions, additional data is sent in the exemplary method. Specifically, the main computer 12 sends 324 (18*18) competition scores for every team in each secondary competition. Thus, another 2916(324 scores *9 characters) characters of competition scores will be sent for each team in the secondary competitions. Consequently, with enough teams in secondary competitions, the second method of data transfer would be more economical.

To account for the variation in the most efficient form of data transfer, the main computer 12 may be configured to determine which data transfer method is more efficient and/or may allow a user to select or define a data transfer method to use.

Kiosks 18 may be stationed throughout the clubhouse and are provided to allow real-time interaction with the golfers and spectators. More specifically, the kiosks 18 provide a dual function: (1) they enable the golfers and/or spectators to view standings of the various competitions updated on a hole by hole basis and (2) they allow golfers and spectators to create their own simulation competitions having a unique scoring format with participants from different main competitions or rounds of main competitions and with participants being on different teams.

This increases the appeal of golf by enabling golfers or spectators to see, for example, who would have won (or would be winning) a tournament under a different scoring format, how teams of different participants would have fared (or would be faring), and how participant from one main competition would fare against participants of other main competitions.

Each kiosk 18 includes an input device and a display device, and may further include a CPU and a memory. The steps performed by a kiosk 18 will be described with reference to FIG. 9. Block 500 represents the kiosk 18 receiving a request from a user with the input device. Decision diamond 502–504 represent the kiosk 18 identifying the request and responding accordingly. If the request is to display standing and/or statistics of the competition(s) the kiosk displays the standings and statistics according to the user's selections, as indicted by decision diamond 502 and block 506.

Decision diamond 504 represents the kiosk 18 determining whether it received a request to create a simulation competition. If so, the kiosk 18 performs steps 508–516 in order to create the simulation competition, score the competition, and output the scores to the user.

Block 508 represents the kiosk 18 receiving a scoring format. This may be performed by the user selecting an existing scoring format or creating a new scoring format, e.g., by editing a new or existing scoring format template. To create a new scoring format, the kiosk 18 receives information, such as the number of participants per team, for the scoring format from the user in a similar manner as that described with respect to secondary competitions.

Once a scoring format is received, the kiosk 18 determines the main competitions whose raw scores can be used, displays a list of these main competitions and receives the users selection of a main competition or round of a main competition, as indicated at block 310. Acceptable main competitions are determined based on compatibility of the scoring format with the competition based on number of holes.

Block 512 represents the kiosk 18 displaying a list of the participants in the selected competition or round and receiving the user's selection of the participants from the selected competition or round for use in the simulation competition. The user may select participants from any acceptable main competition for a simulation competition. Once the participants are set, the user may define in the kiosk 18 multiple-participant teams according to the scoring format.

Next, the kiosk 18 may then calculate a net score, a competition score, and/or a cumulative competition score for each participant based on the simulation scoring format, as indicated at block 514. The scores may then be displayed for the user.

In alternate embodiments, the kiosk 18 may receive the participants for the simulation competition prior to receiving a scoring format. In which case, the flexibility of the scoring format may be limited by the selected competition.

While the above steps have been described from the perspective of the kiosk 18, it should be appreciated that any of the underlining functions may be performed by any computer. For example, simulation competition routine 66 may involve the main computer 12 performing the functions of the kiosk 18 illustrated above. In addition, the various data retrieved for displaying standings and creating simulation tournaments, for example, the scoring data, the tournament data and the scoring formats, may be retrieved from the memory of the main computer 12 or from the memory of the kiosk 18. In the latter instance, the kiosk 18 may receive tournament data and scoring data similar to the remote computers 14.

Details of the server computer 26 and the internet 28 will now be described. The server computer 26, for example, a personal computer, workstation, minicomputer, or mainframe, typically executes a World Wide Web (WWW) daemon such as IBM's HTTP Daemon or other WWW daemon and is coupled to the internet 28, a network which may include other networks such as LANs, WANs, and SNA networks, so as to provide access for client computers 30. The client computers 30 typically execute a Web browser such as IBM's Web Explorer or NetScape or Mosaic to facilitate interaction with the server computer.

In general, a client computer 30 user interacts with the Web browser and, at some point, executes an HyperText Transfer Protocol (HTTP) command via the Web browser that results in communication with an HTTP daemon executing on the server computer 26. The HTTP command may be a call to an HyperText Markup Language (HTML) input form. The server computer 26 transmits the HTML form to the client computer 30 where it is displayed to the user. The user manipulates the HTML input form via the Web browser, by selecting functions and/or entering data into input boxes. When the user invokes a "submit" or "post" command in conjunction with the HTML input form, the data from the HTML input form 28, along with the command, is transmitted to the Web server 22. The "submit" or "post" command typically is a hyperlinked item from the HTML input form 28 which comprises a universal resource locator (URL) that invokes a function on the server computer 26 for processing the client's request.

The raw scoring data, tournament data, and participant data for each competition residing on the main computer 12 located at the golf course is periodically transmitted to the server computer 26. When the data is received the server computer 26 calculate scores and statistical data and automatically formats it into HTML making the data suitable for display by client's Web browser so that standings of the competitions and statistics of the participants may be viewed.

In addition, the server computer 26 may be accessed by client computer 30 for creating and scoring simulation competitions. For example, similar to the kiosks 18, the server computer 26, may create a scoring format in response to client requests, determine acceptable competitions for use with the scoring format, display the acceptable competitions to the client, receive a main competition or round selection from the client, display the participants of the selected main competition or round, receive participants and participant teams for the simulation competition, generate competition scores for the participants, and transmit the scores to the client for display thereby. As with the kiosks 18, participants from different competitions may be selected.

Alternatively, an executable program may be provided to the client, e.g., by downloading, for creating scoring formats and simulation competitions and for calculating competition scores based on the scoring format. In which case, the server computer 26 merely transmits raw scores to the client.

Providing information to the Internet provides a valuable extension to the golf course scoring system by allowing the golfer, the spectators, and even the public to view the results of the competitions from a remote site, for example, work or home. Also, as with the kiosks 18, internet access allows users to create their own simulation competitions with different participants, different teams, and different scoring formats than the competitions created by the tournament organizer, thereby further increasing the appeal of golf.

Figure 8:
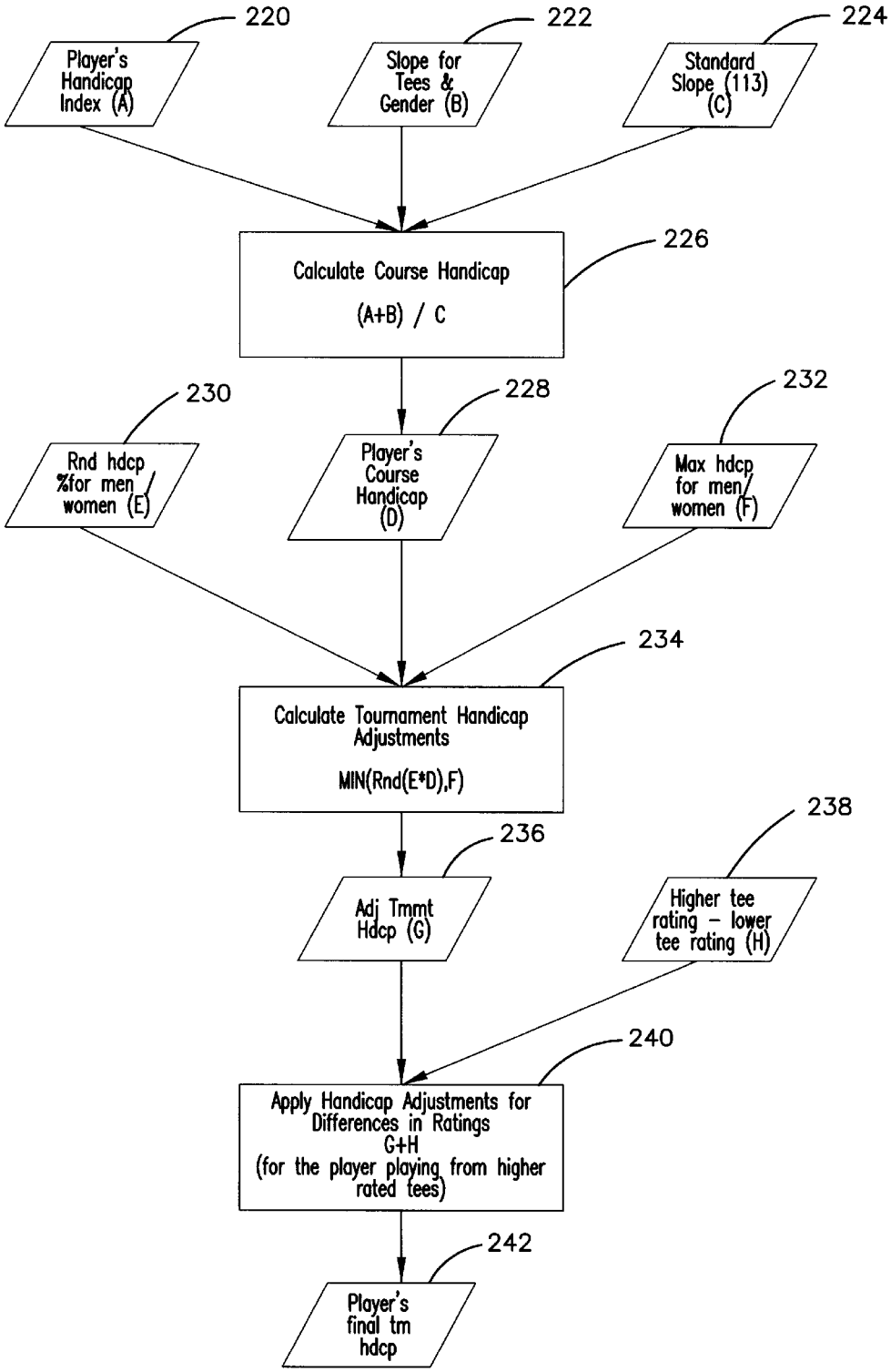
FIG. 8 is a flow chart illustrating an exemplary method for calculating tournament handicaps for the golf participants.
Figure 9:
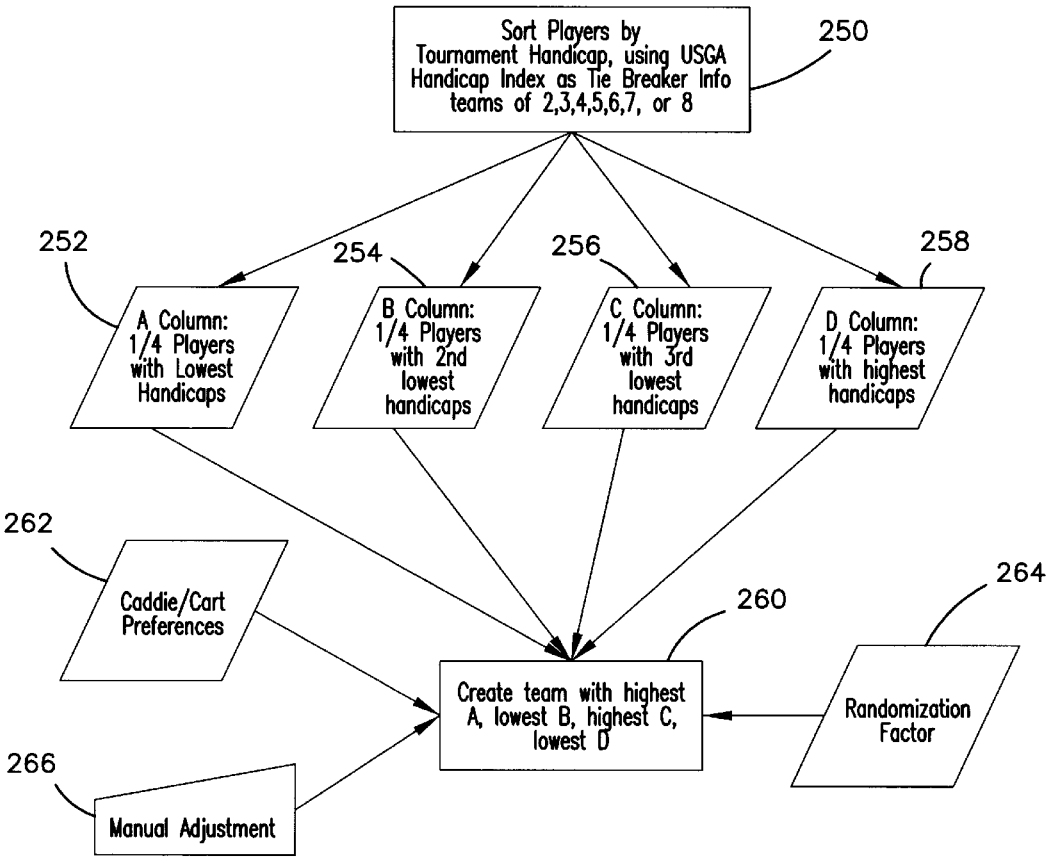
FIG. 9 is a flow chart illustrating an exemplary method for sorting the golf participants into teams.

Further details of the system 10 will be illustrated with references to FIGS. 8 and 9. FIG. 8 illustrates an exemplary method for calculating a player tournament handicap. In general, a player tournament handicap is calculated based on a player's USGA Handicap Index, the USGA slope rating for the tees they are playing, the type of scoring format, and the difference in tee ratings for their competitors. The handicap is then allocated across the holes.

According to the exemplary method, a course handicap is first calculated using the player's USGA handicap index, the slope of the tees and gender of the player, and the standard slope, as indicated by blocks 220–226. Second, as indicated by blocks 228–234, the main computer 12 calculates an adjusted tournament handicap for the player based on the course handicap, the round handicap percentage, and the maximum handicap. Finally, a tournament handicap is determined, by making additional handicap adjustments for players playing from different tees and men and women playing on the same tees, as indicated by blocks 236–242.

FIG. 9 illustrates an exemplary method for sorting a list of players or participants where the scoring format requires teams of four players or participants. The list is a player list for main competitions and a participant list for secondary competitions.

First the players (or participants) are sorted into four tiers, for example, ABCD, based on their tournament handicap using USGA handicap indexes as tie breakers, as indicated by blocks 250–258. Next, teams of four players (or participants) each are generated by teaming the highest player (or participant) in the first tier A, the lowest in second tier B, the highest in third tier C, the lowest in fourth tier D, and so forth, as indicated at block 260. The generation of the pairings may adjusted by cart/caddie preference or with randomization as indicated at blocks 262 and 264, or manually, as indicated at block 266.

It should be appreciated that sorting of a list of players for a main competition results in pairings of players according to the pairing parameters of the scoring format.

The foregoing description of embodiments of the present invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but rather extend to cover the full and fair scope of the claims set forth below.

What is claimed is:

1. A computer-implemented method for dynamically scoring a plurality of golf players playing golf on a golf course using a computer system including at least one main computer, the method comprising the steps of:

(a) defining in the main computer a plurality of golf participants from the plurality of golf players, wherein at least one of the golf participants includes two or more players playing a common ball;

(b) defining in the main computer a plurality of competitions of the golf participants, wherein a first one of the golf participants is teamed with a second one of the golf participants in a first competition and the first golf participant is teamed with a different golf participant in a second competition; wherein the second competition is a simulation competition (c) assigning a scoring format to each of the plurality of competitions;

(d) providing raw score data of the golf participants to the main computer;

(e) calculating, using the main computer, a competition score for each golf participant for each of the plurality of competitions in which the golf participant is playing, wherein each competition score is based on the raw score data and the scoring format assigned to the respective competition; and (f) outputting the competition scores.

2. The method of claim 1, wherein the computer system further includes one or more remote computers, each remote computer being associated with a hole of the golf course, and wherein the providing step (d) comprises the steps of receiving into one of the remote computers a raw score for a particular hole for a particular one of the golf participants and communicating the raw score for the particular golf participant to the main computer.

3. The method of claim 2, further comprising the step of communicating the raw score for the particular golf participant to each of the remote computers using the main computer.

4. The method of claim 2, further comprising the step of selectively communicating from the main computer the raw score for the particular golf participant to a subset of the remote computers.

5. The method of claim 4, wherein the subset consists of all of the remote computers save the one of the remote computers which received the raw score for the particular golf participant.

6. The method of claim 4, wherein the subset consists of each of the remote computers associated with holes to be played after the particular one of the holes for which the raw score was received.

7. The method of claim 6, wherein the outputting step comprises the step of communicating the competition scores to each of the remote computers using the main computer.

8. The method of claim 4, wherein the subset consists of the remote computers associated with holes to be played after the particular one of the holes for which the raw score was received and the remote computer associated with the hole played immediately prior to the particular one of the holes for which the raw score was received.

9. The method of claim 1, wherein:

the defining step (b) includes the steps of receiving the simulation competition from an input device coupled to the main computer, wherein the simulation competition includes some of the golf participants in one of the plurality of competitions; and the assigning step (c) further includes the steps of receiving a simulation scoring format for the simulation competition from the input device, wherein a simulation competition score is calculated for each golf participant in the simulation competition using the raw score data for the golf participants in the simulation competition and the simulation scoring format.

10. The method of claim 9, wherein the simulation competition is a secondary competition.

11. The method of claim 1, further comprising the steps of:

periodically transmitting the raw scoring data received by the main computer to a server computer coupled to the main computer;

receiving with the server computer the simulation competition from a client computer coupled to the server computer via the internet, wherein the simulation competition includes some of the golf participants of one of the plurality of competitions; and receiving with the server computer a simulation scoring format for the simulation competition from the client computer.

12. The method of claim 11, wherein the server computer calculates a simulation competition score for each golf participants in the simulation competition using the raw score data for the golf participants of the simulation competition and the simulation scoring format.

13. The method of claim 11, wherein the server computer transmits the raw score data for the golf participants in the simulation competition to the client computer for calculation of simulation competition scores by the client computer.

14. The method of claim 11, wherein the simulation competition is a secondary competition.

15. The method of claim 1, wherein the providing step (d) comprises the steps of:

receiving the raw score data in a remote computer associated with a hole on the golf course; and communicating the raw score data to the main computer via a wireless communication network.

16. The method of claim 15, wherein the communicating step comprises the steps of selecting a communications protocol from a plurality of communications protocols and formatting the raw score data based on the selected communications protocol.

17. The method of claim 1, wherein the outputting step comprises the step of communicating the competition scores to a remote computer associated with a hole on the golf course via a wireless communications network.

18. The method of claim 17, wherein the communicating step comprises the steps of selecting a communications protocol from a plurality of communications protocols and formatting the competition scores based on the selected communications protocol.

19. The method of claim 1, wherein the assigning step includes the step of defining in the main computer each scoring format, wherein each scoring format includes scoring methods for a plurality of holes of the competition, and wherein a scoring method for a first one of the holes differs from a scoring method for a second one of the holes.

20. The method of claim 19, wherein the scoring method for the first one of the holes uses different raw stroke data than the scoring method of the second one of the holes.

21. The method of claim 19, wherein the scoring method for the first one of the holes uses the raw stroke data for one of the golf participants playing from a first color tee and the scoring format for the second one of the holes uses the raw stroke data for the one golf participant playing from a different color tee.

22. The method of claim 1, further including defining in the main computer a third competition of golf participants, wherein the first golf participant is teamed with a third golf participant different than both the second golf participant and the different golf participant.

23. The method of claim 1, wherein the first golf participant is a golf participant which includes two or more players playing a common ball.

24. The method of claim 23, wherein the second golf participant is a golf participant which includes two or more players playing a common ball.

25. The method of claim 24, wherein the different golf participant is a golf participant which includes two or more players playing a common ball.

26. A computer system, including at least one main computer, for dynamically scoring a plurality of golf players playing golf on a golf course, comprising:

(a) means for defining in the main computer a plurality of golf participants from the plurality of golf players, wherein at least one of the participants includes two or more players playing a common ball;

(b) means for defining in the main computer a plurality of competitions of the golf participants, wherein a first one of the golf participants is teamed with a second one of the golf participants in a first competition and the first golf participant is teamed with a different golf participant in a second competition wherein the second competition is a simulation competition;

(c) means for assigning a scoring format to each of the plurality of competitions;

(d) means for providing raw score data of the golf participants to the main computer;

(e) means for calculating, using the main computer, a competition score for each golf participant for each of the plurality of competitions in which the golf participant is playing, wherein each competition score is based on the raw score data and the scoring format assigned to the respective competition; and (f) means for outputting the competition scores.

27. The system of claim 26, wherein the computer system further includes one or more remote computers, each remote computer being associated with a hole of the golf course, and wherein the providing means (d) comprises means for receiving into one of the remote computers a raw score for a particular hole for a particular one of the golf participants and means for communicating the raw score for the particular golf participant to the main computer.

28. The system of claim 27, further comprising means for communicating the raw score for the particular golf participant to each of the remote computers using the main computer.

29. The system of claim 27, further comprising means for selectively communicating from the main computer the raw score for the particular golf participant to a subset of the remote computers.

30. The system of claim 29, wherein the subset consists of all of the remote computers save the one of the remote computers which received the raw score for the particular golf participant.

31. The system of claim 29, wherein the subset consists of each of the remote computers associated with holes to be played after the particular one of the holes for which the raw score was received.

32. The system of claim 31, wherein the outputting means comprises means for communicating the competition scores to each of the remote computers using the main computer.

33. The system of claim 29, wherein the subset consists of the remote computers associated with holes to be played after the particular one of the holes for which the raw score was received and the remote computer associated with the hole played immediately prior to the particular one of the holes for which the raw score was received.

34. The system of claim 26, wherein:

the defining means (b) includes means for receiving the simulation competition from an input device coupled to the main computer, wherein the simulation competition includes some of the golf participants in one of the plurality of competitions; and the assigning means (c) further includes means for receiving a simulation scoring format for the simulation competition from the input device, wherein a simulation competition score is calculated for each golf participant in the simulation competition using the raw score data for the golf participants in the simulation competition and the simulation scoring format.

35. The system of claim 34, wherein the simulation competition is a secondary competition.

36. The system of claim 26, further comprising:

means for periodically transmitting the raw scoring data received by the main computer to a server computer coupled to the main computer;

means for receiving with the server computer the simulation competition from a client computer coupled to the server computer via the internet, wherein the simulation competition includes some of the golf participants of one of the plurality of competitions; and means for receiving with the server computer a simulation scoring format for the simulation competition from the client computer.

37. The system of claim 36, wherein the server computer calculates a simulation competition score for each golf participants in the simulation competition using the raw score data for the golf participants of the simulation competition and the simulation scoring format.

38. The system of claim 37, wherein the server computer transmits the raw score data for the golf participants in the simulation competition to the client computer for calculation of simulation competition scores by the client computer.

39. The system of claim 37, wherein the simulation competition is a secondary competition.

40. The system of claim 26, wherein the providing means (d) comprises:

means for receiving the raw score data in a remote computer associated with a hole on the golf course; and means for communicating the raw score data to the main computer via a wireless communication network.

41. The system of claim 40, wherein the communicating means comprises means for selecting a communications protocol from a plurality of communications protocols and means for formatting the raw score data based on the selected communications protocol.

42. The system of claim 26, wherein the outputting means comprises means for communicating the competition scores to a remote computer associated with a hole on the golf course via a wireless communications network.

43. The system of claim 42, wherein the communicating means comprises means for selecting a communications protocol from a plurality of communications protocols and formatting the competition scores based on the selected communications protocol.

44. The system of claim 26, wherein the scoring format includes scoring methods for a plurality of holes of the competition, and wherein a scoring method for a first one of the holes differs from a scoring method for a second one of the holes.

45. The system of claim 44, wherein the scoring method for the first one of the holes uses different raw stroke data than the scoring method of the second one of the holes.

46. The system of claim 44, wherein the scoring method for the first one of the holes uses the raw stroke data for one of the golf participants playing from a first color tee and the scoring format for the second one of the holes uses the raw stroke data for the one golf participant playing from a different color tee.

47. A system for dynamically scoring a plurality of golf participants playing golf on a golf course, comprising:

at least one main computer;

means for defining in the main computer a plurality of golf participants from the plurality of golf players, wherein at least one of the participants includes two or more players playing a common ball, means for defining in the main computer a plurality of competitions of the golf participants, wherein a first one of the golf participants is teamed with a second one of the golf participants in a first competition and the first golf participant is teamed with a different golf participant in a second competition; wherein the second competition is a simulation competition means for assigning a scoring format to each of the plurality of competitions;

one or more remote computers each associated with a hole on the golf course; and a communications network coupling the main computer with each remote computer for communication there between, wherein each remote computer receives a raw score for each golf participant playing the associated hole, calculates a local competition score for the associated hole for each golf participant for each of the plurality of competitions in which the golf participant is playing based on the raw score for the golf participant, and communicates the raw scores to the main computer, and wherein the main computer calculates a competition score for each golf participant for each of the plurality of competitions in which the golf participant is playing based on the raw scores communicated by each remote computer and communicates the competition scores to each remote computer.

48. The system of claim 47, wherein one of the remote computers receives the raw score for a particular one of the golf participants for the associated hole and communicates the raw score for the particular golf participant to the main computer and the main computer communicates the raw score for the one golf participant to each remote computer.

49. The system of claim 47, wherein one of the remote computers receives the raw score for a particular one of the golf participants for the associated hole and communicates the raw score for the particular golf participant to the main computer and the main computer selectively communicates the raw score for the particular golf participant to a subset of the remote computers.

50. The system of claim 49, wherein the subset consists of all of the remote computers save the one of the remote computers which received the raw score for the particular golf participant.

51. The system of claim 49, wherein the subset consists of each of the remote computers associated with holes to be played after the hole associated with the one of the remote computers which received the raw score for the particular golf participant.

52. The system of claim 49, wherein the subset consists of each of the remote computers associated with holes to be played after the hole associated with the one of the remote computers which received the raw score for the particular golf participant and the remote computer associated with the hole played immediately prior to the hole associated with the one of the remote computers which received the raw score for the particular golf participant.

53. The system of claim 47, wherein the communications network includes a wireless communications network.

54. The system of claim 53, wherein the remote computers are solar powered.

55. The system of claim 53, wherein the main computer and each remote computer select a communications protocol from a plurality of communications protocols and format the information being communicated therebetween based on the selected communications protocol.

56. The system of claim 47, wherein the main computer receives a user-defined competition of the golf participants and a user-defined scoring format for the competition of the golf participants, wherein the competition scores are calculated using the user-defined scoring format.

57. The system of claim 47, further including a simulation computer coupled to the main computer, wherein simulation computer receives the simulation competition of the golf participants and a scoring format for the simulation competition.

58. The system of claim 57, wherein the simulation computer communicates the simulation competition and the simulation scoring format to the main computer, wherein the main computer calculates a simulation competition score for each of the golf participants in the simulation competition using the raw scores provided by each remote computer and the simulation scoring format and communicates the simulation competition scores to the simulation computer.

59. The system of claim 57, wherein the simulation computer communicates the simulation competition to the main computer and in response thereto, the main computer communicates the raw scores of the golf participants in the simulation competition to the simulation computer so that the simulation computer may calculate a simulation competition score for each golf participant in the simulation competition using the communicated raw scores and the simulation scoring format.

60. The system of claim 47, further including a server computer coupled to the main computer, wherein the server computer:

receives the raw scores from the main computer; and receives the simulation competition and a simulation scoring format for the simulation competition from a client computer coupled to the server computer via the internet.

61. The method of claim 60, wherein the server computer calculates a simulation competition score for each of the golf participants in the simulation competition using the raw scores and the simulation scoring format and communicates the simulation competition scores to the client computer.

62. The system of claim 60, wherein the server computer communicates the raw scores of the golf participants in the simulation competition to the client computer for calculation of a simulation competition score for each golf participant in the simulation competition by the client computer using the communicated raw scores and the simulation scoring format.

63. A computer-implemented method for dynamically scoring a plurality of golf players playing golf on a golf course using a computer system including at least one main computer, the method comprising the steps of:

(a) defining in the main computer a plurality of golf participants from the plurality of golf players, wherein at least one of the golf participants includes two or more players playing a common ball;

(b) defining in the main computer multiple competitions including a main competition of the golf participants and a simulation subcompetition including two or more of the golf participants in the main competition, wherein a first one of the golf participants is teamed with a second one of the golf participants in a first one of the competitions and the first golf participant is teamed with a different golf participant in a second one of the competitions;

(c) assigning a scoring format to each of the multiple competitions;

(d) providing raw score data of the golf participants to the main computer;

(e) calculating, using the main computer, a competition score for each golf participant for each of the multiple competitions in which the golf participant is playing, wherein each competition score is based on the raw score data and the scoring format assigned to the respective competition; and (f) outputting the competition scores.

* * * * *